US009528451B2

(12) United States Patent
Kim

(10) Patent No.: US 9,528,451 B2
(45) Date of Patent: Dec. 27, 2016

(54) METHOD OF IMPROVING PERFORMANCE OF SYSTEM FOR CONTROLLING INTERMEDIATE LOCK POSITION CONTINUOUSLY VARIABLE VALVE BY COMPENSATING IGNITION TIMING

(71) Applicants: Hyundai Motor Company, Seoul (KR); Kia Motors Corporation, Seoul (KR)

(72) Inventor: Hyun Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 52 days.

(21) Appl. No.: 14/740,822

(22) Filed: Jun. 16, 2015

(65) Prior Publication Data

US 2016/0153372 A1 Jun. 2, 2016

(30) Foreign Application Priority Data

Dec. 1, 2014 (KR) ..... 10-2014-0169656

(51) Int. Cl.

| | |
|---|---|
| ***F02P 5/15*** | (2006.01) |
| ***F02D 37/02*** | (2006.01) |
| ***F01L 1/04*** | (2006.01) |
| ***F01L 1/34*** | (2006.01) |
| ***F02P 5/04*** | (2006.01) |

(Continued)

(52) U.S. Cl.

CPC ..... *F02D 37/02* (2013.01); *F01L 1/04* (2013.01); *F01L 1/34* (2013.01); *F01L 1/3442* (2013.01); *F01L 13/00* (2013.01); *F02P 5/045* (2013.01); *F02P 5/1504* (2013.01); *F02P 5/1506* (2013.01); *F01L 2001/34463* (2013.01); *F01L 2013/111* (2013.01); *F02D 2250/21* (2013.01)

(58) Field of Classification Search

CPC ..... F01L 2001/34463; F02P 5/1504; F02P 5/1506; F02D 2250/21

USPC .... 123/90.15–90.18, 406.23, 406.24, 406.59

See application file for complete search history.

(56) References Cited

U.S. PATENT DOCUMENTS 6,499,449 B2 * 12/2002 Michelini ..... F02D 37/02 123/198 F
6,561,145 B1 * 5/2003 Stockhausen ..... F01L 9/02 123/198 F (Continued)

FOREIGN PATENT DOCUMENTS

JP 2001-41012 A 2/2001
JP 2003-201945 A 7/2003

(Continued)

*Primary Examiner* — Erick Solis

(74) *Attorney, Agent, or Firm* — Morgan, Lewis & Bockius LLP

(57) ABSTRACT

A method for improving performance of a system that controls a intermediate lock position continuously variable valve may include: obtaining a cam position using an engine Electronic Control Unit (ECU) that has started controlling a position of a intermediate lock position Continuously Variable Valve Timing System (CVVT); determining, using the ECU, whether the cam position corresponds to parking of the intermediate lock position CVVT; compensating an engine ignition timing to prevent cam undershoot, if it is determined that the cam position corresponds to the parking of the intermediate lock position CVVT; and returning to ignition timing control according to an engine operation condition after compensating the engine ignition timing.

6 Claims, 6 Drawing Sheets

(51) Int. Cl.
*F01L 13/00* (2006.01)
*F01L 1/344* (2006.01)

(56) References Cited

U.S. PATENT DOCUMENTS

| | | | | |
|---|---|---|---|---|
| 7,188,594 | B2 * | 3/2007 | Yoshizawa | F01L 13/0021 123/399 |
| 2002/0073963 | A1 * | 6/2002 | Cullen | F01L 1/34 123/406.23 |
| 2011/0307159 | A1 * | 12/2011 | Nakasaka | F02D 13/0215 701/102 |
| 2014/0069360 | A1 * | 3/2014 | Kobayashi | F01L 1/34 123/90.15 |
| 2014/0202407 | A1 | 7/2014 | Miyamoto et al. | |
| 2015/0040863 | A1 * | 2/2015 | Kaneko | F02P 5/142 123/406.12 |
| 2016/0024980 | A1 * | 1/2016 | Sakata | F01L 1/3442 123/90.17 |
| 2016/0130987 | A1 * | 5/2016 | Mitsuhashi | F01L 1/3442 123/90.15 |

FOREIGN PATENT DOCUMENTS

| | | | |
|---|---|---|---|
| JP | 2005-105943 | A | 4/2005 |
| JP | 2008-180217 | A | 8/2008 |
| JP | 4777331 | B2 | 7/2011 |
| JP | 2011-163270 | A | 8/2011 |
| JP | 2012-207548 | A | 10/2012 |
| KR | 10-2003-0044101 | A | 6/2003 |
| KR | 10-044406 | B1 | 8/2004 |

* cited by examiner

METHOD OF IMPROVING PERFORMANCE OF SYSTEM FOR CONTROLLING INTERMEDIATE LOCK POSITION CONTINUOUSLY VARIABLE VALVE BY COMPENSATING IGNITION TIMING

CROSS-REFERENCE TO RELATED APPLICATIONS

The present application claims priority of Korean Patent Application Number 10-2014-0169656 filed on Dec. 1, 2014, the entire contents of which application are incorporated herein for all purposes by this reference.

BACKGROUND OF INVENTION

Field of Invention

The present invention relates to a method for improving the performance of a system that controls a intermediate lock position type continuously variable valve, and more particularly, to a method for improving the performance of a system that controls a intermediate lock position continuously variable valve by compensating an ignition timing without a drop in engine RPM due to CAM undershoot.

Description of Related Art

Recently, as the demand for improving fuel efficiency, low-speed torque, and output and reducing an exhaust gas increases, it has been required to improve the performance of a continuously variable valve timing system (or camshaft phaser system, hereafter, referred to as a CVVT) that optimally controls the timings of opening/closing intake/exhaust valves in accordance with the RPM of an engine.

As an example of satisfying the demand for improving the performance of a CVVT by improving response of a system and increasing the operation range of a cam, there is a intermediate lock position type continuously variable valve timing system (hereafter, referred as a intermediate lock position CVVT). In particular, in the intermediate lock position CVVT, a solenoid valve (for example, an OCV (Oil-Flow Control Valve)) that forms a channel by moving a spool (or plunger) is provided and an engine ECU (Electronic Control Unit) that applies PWM DUTY (Pulse Width Modulation Duty) controls the position, and the position of a cam is controlled not at the largest retarded (intake) position and the largest advanced position (exhaust), but the middle position (parking), so the response is improved and the use region of the cam is increased in comparison to the CVVT.

Therefore, according to the intermediate lock position CVVT, the effect of improving fuel efficiency by reducing a loss of pumping due to an increase of valve overlap of intake/exhaust valves is further increased, the effect of reducing an exhaust gas by re-burning a combustion gas due to internal EGR by optimizing the valve overlap according to engine conditions is further improved, and the effect of improving output and increasing low-speed torque by increasing volume efficiency by optimizing an intake valve timing according to engine conditions is further increased, thereby improving fuel efficiency and reducing an exhaust gas in comparison to a CVVT.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

However, when an engine is started, the engine ECU moves the parking position of a intermediate lock position CVVT to an advanced position, so an oil channel goes to an advanced channel through a retarded channel, but the intermediate lock position CVVT is retarded when passing through the retarded channel under some poor conditions, so that the RPM of the engine may be dropped. In particular, a drop in engine RPM reduces stability in starting of an engine and causes dissatisfaction from consumers. For example, cam undershoot of −7 degrees causes a drop of about 150 RPM.

Such a drop in engine RPM may be prevented by increasing the electric response speed of a plunger moving in the order of parking=>retarded=>holding=>advanced channels so that oil quickly passes the retarded channel without flowing into the retarded channel, but there is a dead zone until the plunger of a solenoid valve receiving electric energy starts to move, so that there is necessarily a physical limit in improving the response speed of the plunger.

In various aspects, the present invention is directed to provide a method of improving performance of a system for controlling a intermediate lock position type continuously variable valve without a drop in engine RPM due to cam undershoot by compensating an ignition timing instead of improving response of a valve plunger that has a physical limit.

In accordance with some aspects of the present invention, a method for improving performance of a system that controls a intermediate lock position continuously variable valve may include: (A) obtaining a cam position using an engine Electronic Control Unit (ECU) that has started controlling a position of a intermediate lock position Continuously Variable Valve Timing System (CVVT); (B) determining, using the ECU, whether the cam position corresponds to parking of the intermediate lock position CVVT; (C) compensating an engine ignition timing to prevent cam undershoot, if it is determined that the cam position corresponds to the parking of the intermediate lock position CVVT; and (D) returning to ignition timing control according to an engine operation condition after compensating the engine ignition timing.

The compensating of the engine ignition timing may be performed before the intermediate lock position CVVT passes a retarded position. The compensating of the engine ignition timing may compensate a current ignition timing of an engine according to the cam position obtained by the engine ECU. The compensating of the current ignition timing may be achieved by adding a CVVT compensation ignition timing for preventing the cam undershoot to the current ignition timing.

The returning to ignition timing control according to an engine operation condition may be determined based on the cam position. The cam position may be out of or pass the retarded position of the intermediate lock position CVVT.

According to the present invention, it is possible to solve the problem of a drop in engine RPM due to cam undershoot (retard of CVVT) when a CVVT in a intermediate lock position CVVT is operated, and as the problem of a drop in RPM is solved, it is possible to improve stability of a vehicle and preclude dissatisfaction from consumers.

Further, according to the present invention, since the performance of the intermediate lock position CVVT is improved in terms of software by compensating an ignition timing, there is no need for improving the channel and the hardware structure of the intermediate lock position CVVT which is practically difficult to achieve due to the time and cost involved.

The methods and apparatuses of the present invention have other features and advantages which will be apparent from or are set forth in more detail in the accompanying drawings, DETAILED DESCRIPTION serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
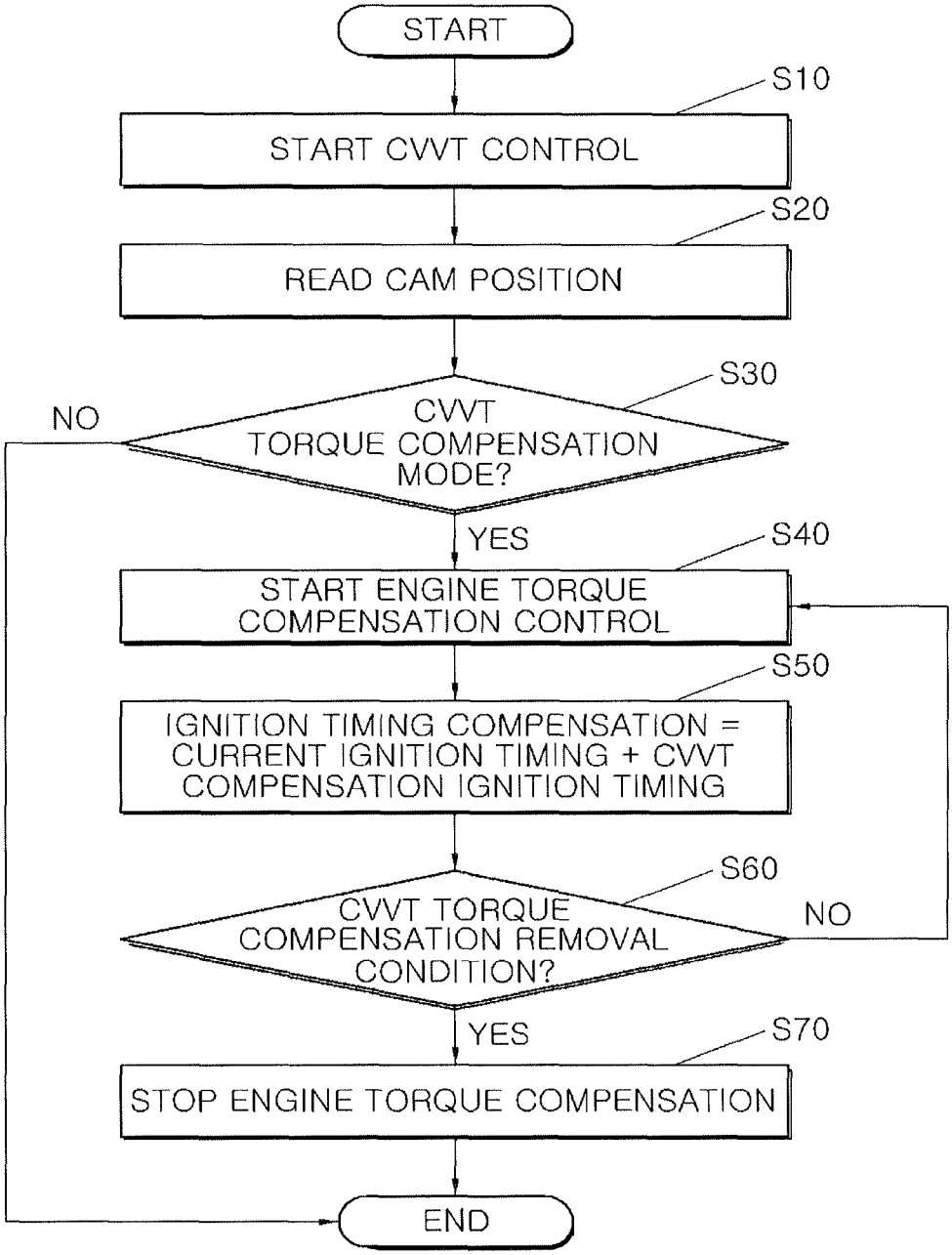
FIG. 1 is a flowchart illustrating an exemplary method of improving performance of a system for controlling a intermediate lock position type continuously variable valve by compensating an ignition timing according to the present invention.
Figure 2A:
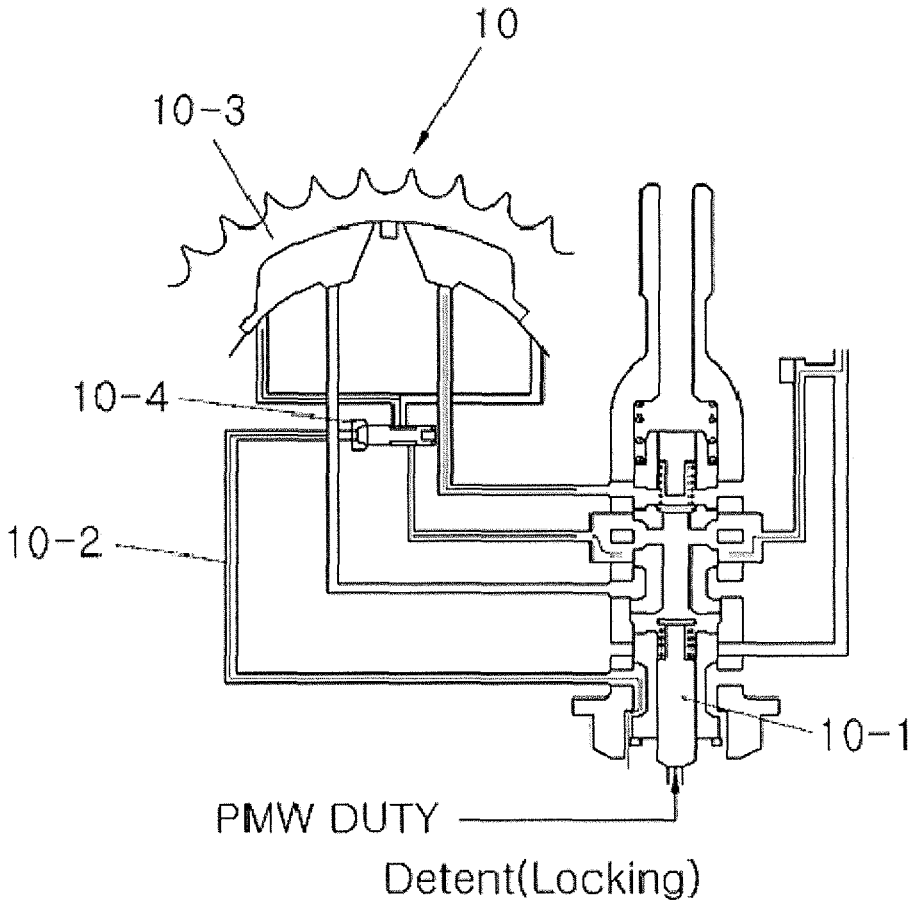
FIG. 2A, FIG. 2B, FIG. 2C and FIG. 2D are diagrams showing an example of cam position control (parking/retarded/holding/advanced) of the system for controlling a intermediate lock position type continuously variable valve according to the present invention.
Figure 2B:
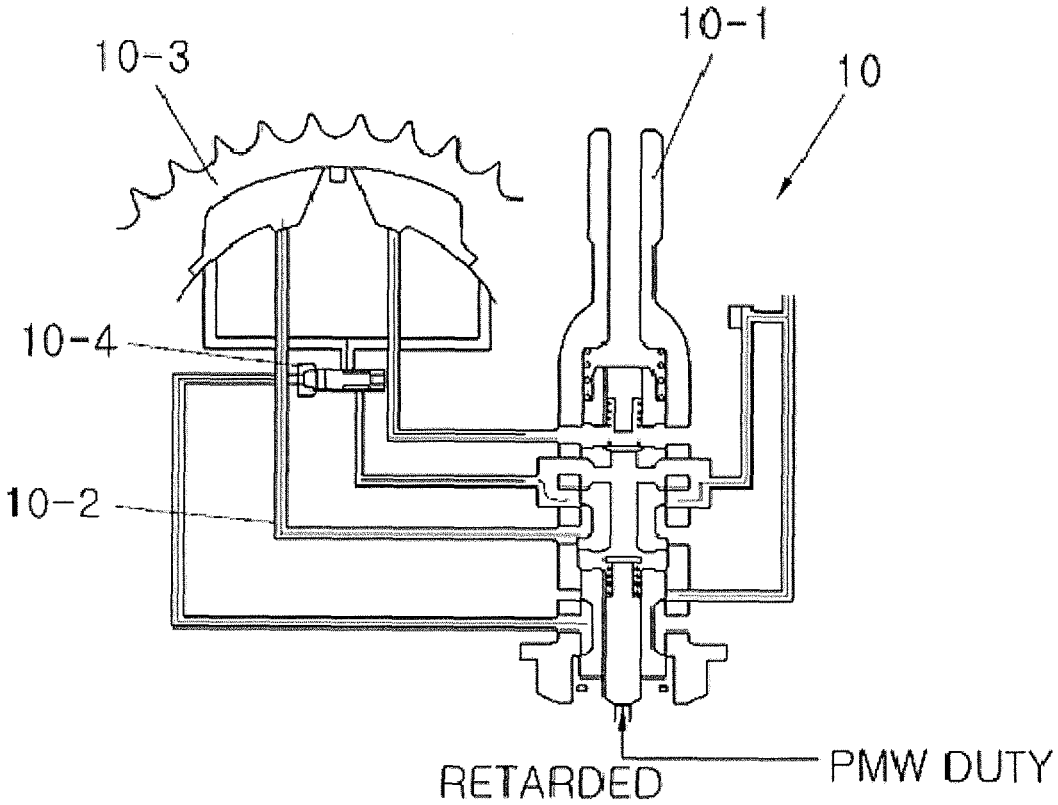
Figure 2C:
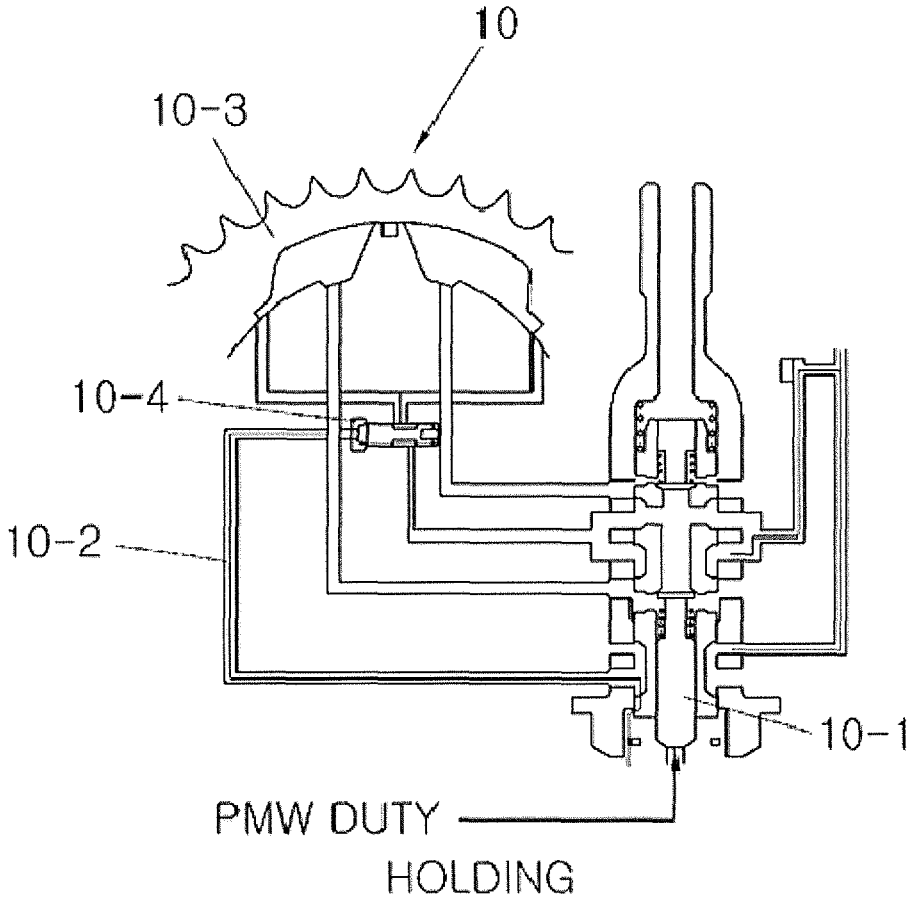
Figure 2D:
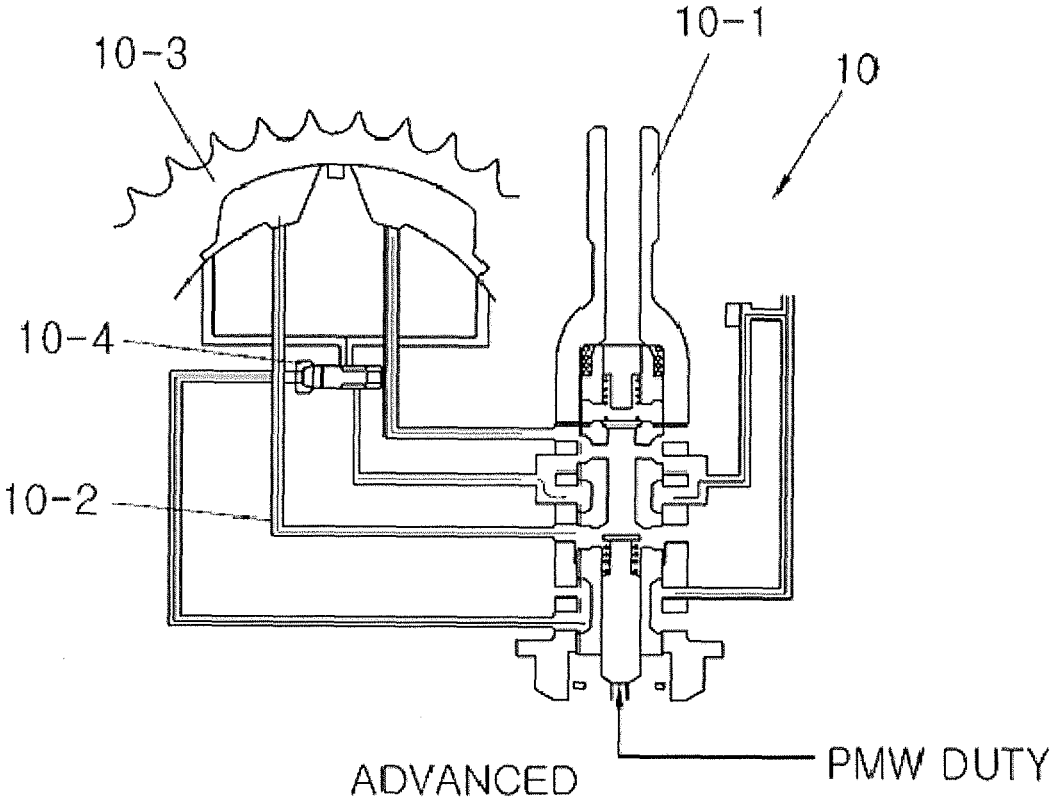

FIG. 1 is a flowchart illustrating an exemplary method of improving performance of a system for controlling a intermediate lock position CVVT by compensating an ignition timing according to the present invention. In some embodiments, the control is performed by an engine ECU (Electronic Control Unit).

As shown in the figure, an engine ECU that controls a intermediate lock position CVVT under an operation control condition performs a CVVT torque compensation mode (S30). The reason can be seen from FIG. 2A, FIG. 2B, FIG. 2C and FIG. 2D showing an operation of a intermediate lock position CVVT following the order of parking (detent or locking)=>retarded=>holding=>advanced channels. As shown in the figure, the intermediate lock position CVVT includes an OCV 10-1, a hydraulic circuit 10-2 connected to a cam 10-3 for controlling an intake valve and an exhaust valve is connected to the OCV 10-1, the hydraulic circuit 10-2 has a lock pin 10-4 for fixing the cam 10-3 at the middle position between the largest retarded and advanced positions, and a plunger (or a spool) of the OCV 10-1 is moved in response to a PWM duty signal, so that an oil channel for the hydraulic circuit 10-2 is controlled. Accordingly, a PWM duty signal applied to the OCV 10-1 with the engine ECU parked produces oil flow that releases the locking pin 10-4 fixing the cam 10-3 at the intermediate lock position between the largest retarded and advanced positions, and then another PWM duty signal applied to the OCV 10-1 changes the camp 10-3 into retarded—>holding—>advanced positions or in the reverse order.

Accordingly, when the engine ECU controls the position of the intermediate lock position CVVT from the parking position to a holding or an advanced position, which is a desired position, to start an engine, it can be seen that it passes a retarded position and it can be seen that cam undershoot can be prevented only when the oil does not flow into the retarded channel at the time the intermediate lock position CVVT passes the retarded channel.

Therefore, by using the type of compensating an ignition timing using a cam position moving from a retarded position to an advanced position instead of using the OCV 10-1 having a physical limit in the CVVT torque compensate mode (S30), it is possible to remove cam undershoot or prevent a drop in engine RPM.

In detail, when the engine ECU starts controlling the intermediate lock position CVVT under the operation control condition, as in step S10, the ECU reads out the cam position, as in step S20, and determines whether the CVVT torque compensation mode for controlling the position of the intermediate lock position CVVT has been entered, as in step S30. In the CVVT torque compensation mode, a condition that the current cam position is the parking position and the desired position with the intermediate lock position CVVT in operation is the holding or advanced position.

In step S30, when there is no need for entering the CVVT torque compensation mode, the engine ECU controls the position of the intermediate lock position CVVT without compensating the ignition timing, which means that the intermediate lock position CVVT of which the position is controlled by the engine ECU has already passed the retarded channel. The position of the intermediate lock position CVVT without the CVVT torque compensation mode applied is made in the order of parking=>retarded=>holding=>advanced channels without compensation of an ignition timing in the retarded channel.

In contrast, when there is a need for entering the CVVT torque compensation mode in step S30, the engine ECU enters an engine torque compensation control start mode, as in step S40, thereby compensating the ignition timing, as in step S50. The compensation of an ignition timing is achieved by adding a CVVT compensation ignition timing value to the current ignition timing according to the basic operation condition of an engine.

That is, ignition timing compensation=current ignition timing+CVVT compensation ignition timing. In various embodiments, the CVVT compensation ignition timing is a value obtained by an actual test on a vehicle and stored as a map or data in the engine ECU. In some embodiments, a specific CVVT compensation ignition timing is obtained for each vehicle and stored in the corresponding engine ECU because the optimal calibration is different for each vehicle.

Figure 3:
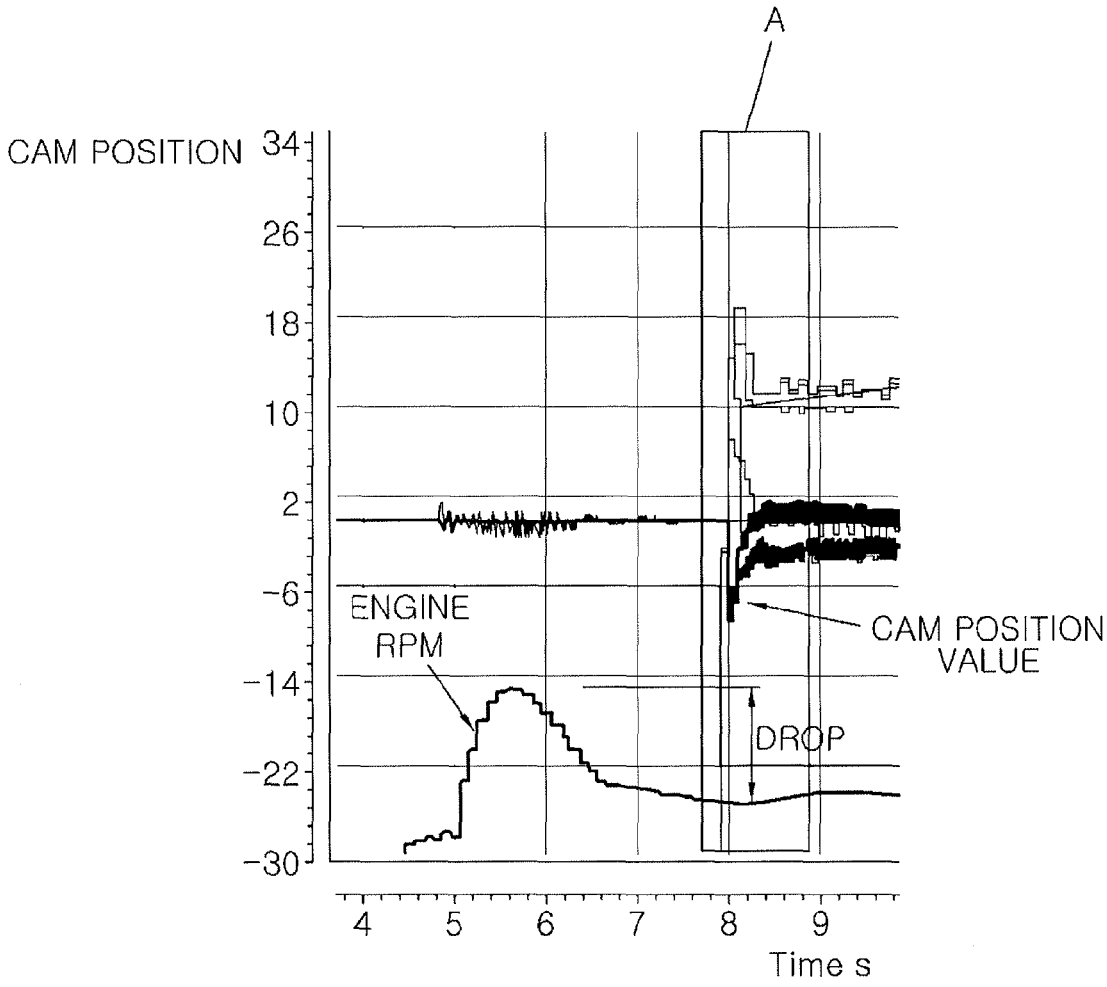
FIG. 3 is an example of a cam position curve showing an ignition timing compensation period according to the present invention.

The point of time to apply the ignition timing compensation is exemplified in FIG. 3, in which "A" means a cam position value where a drop in engine RPM is generated, so it indicates the point of time to apply ignition timing compensation. Accordingly, as the result of the ignition timing compensation, the cam undershoot can be removed and a drop in engine RPM can be prevented in the retarded channel where the intermediate lock position CVVT transits from parking position to the retarded position when its position is controlled.

After the ignition timing compensation is made in step S50, the engine ECU checks the CVVT torque compensation removal condition, as in step S60. For this purpose, the engine ECU determines whether the cam position has passed the retarded position, by reading out again the cam position. This is because when the cam position has passed the retarded position, the cam undershoot causing a drop in engine RPM is removed or corrected and there is no need for compensating the engine torque any more.

When the cam position has not passed the retarded position yet in step S60, the process returns to step S40 and continues the ignition timing compensation control, but when the cam position has passed the retarded position in step S60, the process enters step S70 and stopping the engine torque compensation, thereby finishing the CVVT torque compensation mode. Accordingly, the engine ECU keeps controlling the position of the intermediate lock position CVVT to the holding or advanced position that is the desired position.

As described above, according to the method of improving performance of a system for controlling a middle phase type continuously variable valve by compensating an ignition timing according to some embodiments, the engine ECU that has started controlling the position of the intermediate lock position CVVT reads out the cam position, determines the cam position corresponding to parking of the intermediate lock position CVVT, and then compensates the engine ignition timing to prevent cam undershoot. Further, it returns to the ignition timing control according to the engine operation condition after compensating the engine ignition timing, so it is possible to prevent a drop in engine RPM due to cam undershoot (retard of CVVT) when a CVVT in the intermediate lock position CVVT is operated. In particular, the performance of the intermediate lock position CVVT is improved in terms of software by compensating the ignition timing, so that there is no need for improving the channel and the hardware structure of the intermediate lock position CVVT which is practically difficult to achieve due to too much time and cost.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for improving performance of a system that controls a intermediate lock position continuously variable valve, the method comprising:

(A) obtaining a cam position using an engine Electronic Control Unit (ECU) that has started controlling a position of a intermediate lock position Continuously Variable Valve Timing System (CVVT);

(B) determining, using the ECU, whether the cam position corresponds to parking of the intermediate lock position CVVT;

(C) compensating an engine ignition timing to prevent cam undershoot, if it is determined that the cam position corresponds to the parking of the intermediate lock position CVVT; and (D) returning to ignition timing control according to an engine operation condition after compensating the engine ignition timing.

2. The method of claim 1, wherein the compensating of the engine ignition timing is performed before the intermediate lock position CVVT passes a retarded position.

3. The method of claim 2, wherein the compensating of the engine ignition timing compensates a current ignition timing of an engine according to the cam position obtained by the engine ECU.

4. The method of claim 3, wherein the compensating of the current ignition timing is achieved by adding a CVVT compensation ignition timing for preventing the cam undershoot to the current ignition timing.

5. The method of claim 1, wherein the returning to the ignition timing control according to the engine operation condition is determined based on the cam position.

6. The method of claim 5, wherein the cam position is out of or passes the retarded position of the intermediate lock position CVVT.

* * * * *